United States Patent [19]

Tajima et al.

[11] 4,297,970

[45] Nov. 3, 1981

[54] DEVELOPING APPARATUS

[75] Inventors: Hatsuo Tajima, Matsudo; Nagao Hosono, Chofu; Junichiro Kanbe, Tokyo, all of Japan

[73] Assignee: Canon Kabushiki Kaisha, Tokyo, Japan

[21] Appl. No.: 126,865

[22] Filed: Mar. 3, 1980

[30] Foreign Application Priority Data

Mar. 9, 1979 [JP] Japan ..... 54-27327

[51] Int. Cl.[3] ..... G03G 15/06; G03G 15/09

[52] U.S. Cl. ..... 118/652; 118/658

[58] Field of Search ..... 118/657, 658, 652

[56] References Cited

U.S. PATENT DOCUMENTS 3,882,821 5/1975 Katayama et al. ..... 118/657
4,014,291 3/1977 Davis ..... 118/658 X
4,081,571 3/1978 Nishihama et al. ..... 118/657 X
4,132,192 1/1979 Weyers et al. ..... 118/658

*Primary Examiner*—Bernard D. Pianalto
*Attorney, Agent, or Firm*—Fitzpatrick, Cella, Harper & Scinto

[57] ABSTRACT

A developing apparatus including a rotatable toner supporting member, a magnet fixedly positioned therein and a magnetic blade positioned close to the toner supporting member and in opposed relation to a cutting magnetic pole of the magnet for defining the thickness of the toner layer formed on the toner supporting member. The toner employed has a mean particle size of 5 to 30 microns and contain magnetic powder in a proportion of 15 to 50 wt. %. The magnetic field between the magnetic blade and the cutting pole is maintained at a mean magnetic flux density not lower than 1350 gauss.

14 Claims, 9 Drawing Figures

DEVELOPING APPARATUS

BACKGROUND OF THE INVENTION

1. Field of the Invention

The present invention relates to an apparatus for developing a latent image with a developer, and more particularly to a developing apparatus capable of defining the thickness of a toner layer on a toner supporting member in the presence of a magnetic field for using a carrierless one-component magnetic developer (hereinafter referred to as magnetic toner or simply as toner) in the image development.

2. Description of the Prior Art

The processes conventionally employed in the developing apparatus in the field of electrophotography and electrostatic recording can be classified into dry development and liquid development, and the former is further classified into processes utilizing a two-component developer and those utilizing a one-component developer. The two-component developing processes are differentiated by the carrier employed for transporting the toner particles and include magnetic brush development utilizing iron powder carrier, cascade development utilizing bed carrier, fur brush development utilizing a fur etc. Also the one-component developing process include powder cloud development utilizing suspended cloud of toner particles, contact or donor development in which the toner particles are brought into direct contact with the latent image bearing surface, toner transfer development in which the toner particles are not in direct contact with the latent image bearing surface but are made to fly thereto by the electric field generated by the electrostatic latent image, magnetic dry development in which magnetic electroconductive toner is brought into contact with the latent image bearing surface etc. The two-component developing processes, utilizing a mixed developer composed of carrier particles and toner particles, are inherently associated with a drawback of variation in the developed image density resulting from a change in the mixing ratio of said particles as the toner particles are consumed far faster than the carrier particles with the progress of the development, and also with a drawback of image quality deterioration resulting from the deterioration of difficultly consumable carrier particles after prolonged use thereof.

Among the one-component developing processes, the magne-dry development utilizing magnetic toner and the contact development not utilizing magnetic toner are defective in the tendecy of background fog formation resulting from the undifferential contact of the toner with the entire surface of both the image area and the non-image area. Such background fog formation is a defect also observable in the two-component developing processes. Also in the powder cloud development the background fog formation is inevitable as the deposition of powdered toner particles onto the non-image area is unavoidable.

In the field of the one-component developing processes there is also known a so-called toner transfer development in which the toner is applied uniformly on a bearing member such as a sheet and maintained in opposed relation with a small distance to the latent image bearing surface thereby attracting the toner from said bearing member to the latent image bearing surface by means of the electrostatic charge the latent image to effect the image development, as disclosed in the U.S. Pat. Nos. 2,839,400 and 3,232,190. This process is advantageous in reduced fog formation since the non-image area does not attract the toner nor is brought into contact with the toner. Also the process is alien from the above-mentioned variation in the mixing ratio or the deterioration of the carrier particles because of the absence of carrier particles.

Nevertheless this process has been associated with various difficulties as exemplified in the following:

(1) A uniform toner application on the toner supporting sheet is difficult to achieve although said sheet is in advance provided with an electric field to facilitate the toner application. The toner application for example with a known rigid blade is hardly capable of providing a thin and uniform particle layer, frequently leading to unevenness in the toner layer, which is directly reproduced in the developed image and is therefore not suitable for practical image reproduction. In order to avoid such drawback there has been proposed a process of utilizing paper or cloth on the surface of said toner bearing sheet and embedding the toner particles in the fibers constituting such paper or cloth, but such process does not necessarily ensure uniform application as it is difficult to prepare the toner particles finer than the fiber texture. Also the method of toner application on a bearing sheet in advance by cascade development method is not practical as it requires a large-sized apparatus.

(2) It is difficult to achieve uniform toner release from the toner bearing member. For uniform development a uniform toner release from thus applied toner layer to the image bearing surface is indispensable. Such toner release, being affected by the surface properties of the toner bearing sheet, the state of applied toner thereon and the characteristics of the toner particles, has never been improved to a practical acceptable level.

(3) A low resolving power.

In the conventionally known toner transfer development the toner is electrostatically deposited on the toner bearing member, and, even if it is made possible to form a relatively thin toner layer on said bearing member, the toner particles are released from said bearing member and fly toward the image bearing surface by the mutually repulsive charge of the toner particles when the distance to the image bearing surface becomes reduced approximately to 3 mm. However such wide clearance requires a long flight time for the toner particles from the bearing member therefor to the image bearing surface, and the flying particles are apt to be affected by the air flow in said clearance, the weight of the toner particles and the vibration of the image bearing surface or the toner bearing member, thus tending to result in an aberrated developed image. Also the electric field emanating from the electrostatic image of fine lines or fine-lined characters does not faithfully reach the toner bearing member, thereby resulting in a thinning of fine lines or fine-lined characters or in a significantly lowered resolution due to the lack of toner flight. On the other hand an excessively small clearance will result in a thickening of fine lines or fine-lined characters with loss of resolution, rendering it difficult to obtain faithful reproduction.

The present assignee already proposed, in the United States Patent Application Ser. No. 938,494, filed Aug. 31, 1978, a method of forming a uniform thin toner layer on the toner bearing member without the aforementioned difficulties, said method being featured by the use of a magnetic blade as a toner thickness limiting member and of a magnetic pole positioned in opposed relation to said blade, the toner layer on the toner supporting member being limited to a thin state by means of the magnetic field formed between said magnetic pole and said magnetic blade thereby enabling faithful image reproduction.

It has however been found that an excessively weak magnetic field between said magnetic blade and magnetic pole is unable to form a sufficiently thin toner layer, thus leading to a background fog or aberrated image due to enlarged thickness of the toner layer, while an excessively strong magnetic field provides an excessively thin toner layer, leading a thinning of image, particularly of line images.

SUMMARY OF THE INVENTION

The object of the present invention is to provide an electrostatic image developing apparatus not associated with any of the drawbacks in the conventional apparatus and capable of providing a stable and highly faithful image quality.

Another object of the present invention is to provide a developing apparatus for effecting the image development by forming a thin uniform toner layer on a toner bearing member.

Still another object of the present invention is to provide a developing apparatus capable of repeatedly formly a thin toner layer in a stable manner on the toner bearing member.

According to the present invention the above-mentioned objects are achieved by a developing apparatus comprising a reservoir for holding magnetic toner, a toner bearing member movably supported by said reservoir, magnetic field generating means fixedly provide inside said toner bearing member and a toner thickness limiting member positioned within the extent of the magnetic field emanating from a magnetic pole of said magnetic field generating means and in the vicinity of the external periphery of said toner bearing member, said magnetic toner containing magnetic powder in a proportion from 15 to 50 wt.% and having a mean particle size within a range from 5 to 30 microns, and said magnetic field generating means being provided with a magnetic pole in such a manner that a magnetic field of a mean flux density of not less than 1350 gauss is formed between said toner thickness limiting member and said toner bearing member, thereby forming a toner layer of a determined thickness of said toner bearing member.

The above-mentioned and still other objects and features of the present invention will be made apparent from the following detailed description to be taken in conjunction with the attached drawings.

BRIEF DESCRIPTION OF THE PREFERRED EMBODIMENTS

Now the present invention will be clarified in detail by the embodiments thereof shown in the attached drawings.

Figure 1:
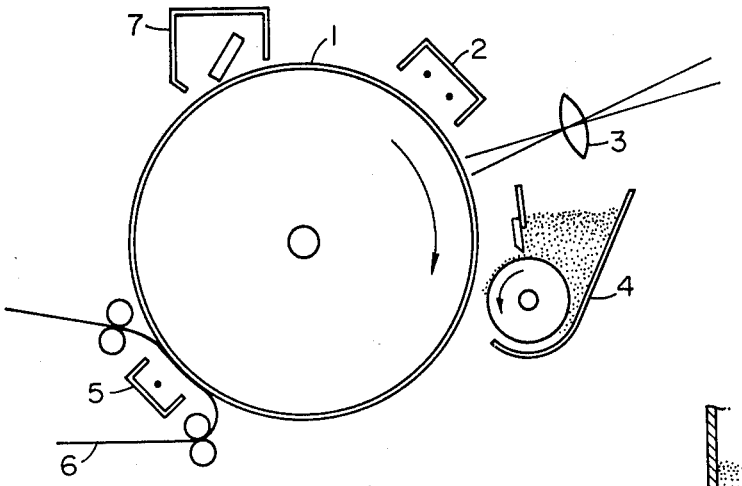
FIG. 1 is a schematic cross-sectional view of an image forming apparatus in which the developing apparatus of the present invention is applicable.

FIG. 1 schematically shows a non-limitative example of the copying or recording apparatus in which the developing apparatus of the present invention is applicable. In FIG. 1, there is provided a photosensitive drum 1 having a photosensitive layer, which can be of any type having or not having a surfacial insulating layer and which may further be replaced by a sheet-shaped of belt-shaped photosensitive member. There are also shown a known sensitizing charger 2 and a light image projecting device 3 for projecting an image of an original, a light image or a light beam modulated by image signals for forming an electrostatic image on said photosensitive member 1. Said electrostatic image formation can be achieved by so-called Carlson process, a process disclosed in the U.S. Pat. Nos. 3,666,363 and 4,071,361 or any other suitable process. 4 represents a developing apparatus of the present invention for forming a visible toner image corresponding to said electrostatic image on the photosensitive member 1, while 5 represents a device for transferring such toner image onto a transfer material 6. For facilitating the transfer said visible image may be provided in advance with a charge for example by corona discharge. It is also possible to employ a so-called electrostatic image transfer process in which the electrostatic image present on the photosensitive member 1 is at first transferred onto another image bearing member and then rendered visible by the developing apparatus 4. 7 represents a cleaning device for removing the toner remaining on the photosensitive member 1 after the image transfer thereby preparing said photosensitive member for reuse.

Figure 2:
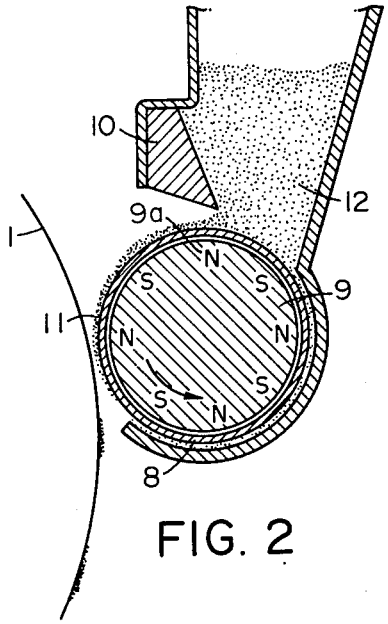
FIG. 2 is a cross-sectional view of a developing apparatus having a toner thickness limiting member.
Figure 3:
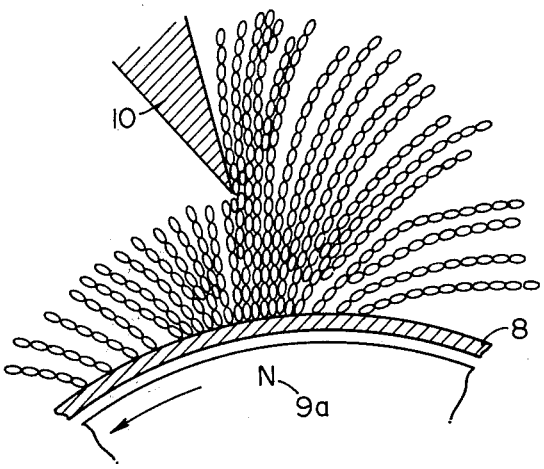
FIGS. 3 and 4 are schematic views showing the working principle of the toner thickness limiting in the developing apparatus shown in FIG. 2.
Figure 4:
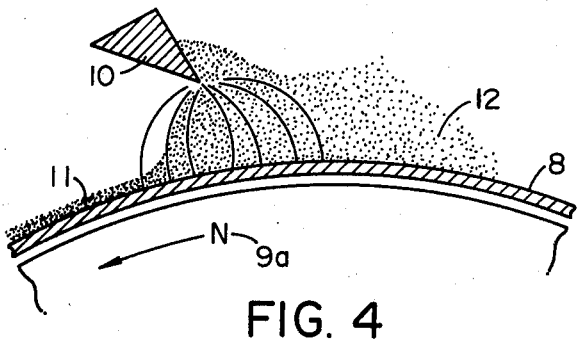

FIGS. 2 to 4 are schematic and explanatory views of a developing apparatus disclosed in the U.S. Pat. application Ser. No. 938,494 of the present assignee, wherein there is provided a photosensitive drum 1 used as the electrostatic image bearing means, which may be replaced by a belt-shaped or sheet-shaped member if desired. 8 is developer bearing means positioned in opposed relationship to said image bearing means and composed, in the illustrated embodiment, of a non-magnetic cylinder. 9 is a magnet fixedly provided in said cylinder and is provided at least with a magnetic pole for taking up the developer onto said cylinder, further preferably with a developing magnetic pole in a developing position facing to the electrostatic image, and with a suitable number of developer transporting poles positioned between the above-mentioned magnetic poles. 10 is a doctor blade for limiting the thickness of the magnetic toner 12 supplied and adhered to the cylinder 8. Said developer bearing means 8 is rotated in the direction of arrow with a toner layer applied thereon to effect the image development without causing the toner contact with the nonimage area of the latent image on the image bearing means 1. The thickness of the toner layer 11 is limited by the magnetic field emanating from the pole 9*a* of the magnet roll 9 and the blade 10, preferably in a range from 30 to 200 microns. In the magnetic field the magnetic toner particles form beads aligned along the lines of magnetic force, with a density significantly lower than in the ordinary state. It is therefore possible, by limiting the toner thickness with a blade in a magnetic field, to obtain a thickness much smaller than that achievable by limitation effected outside the magnetic field. A toner thickness limiting with a blade outside the magnetic field requires an extremely small clearance between the blade and the toner bearing means 8 which is mechanically difficult to achieve. Also such small clearance is unsuitable for stable operation because of eventual clogging thereof for example by coagulated toner. The effect of the magnet 9 for thickness limiting becomes apparent when the magnetic field generated by the pole 9*a* exceeds a certain value as will be explained later.

A thinnest layer is obtained when the blade 10 is maintained, as shown in FIG. 3, in opposed relation to the magnetic pole 9*a*. Furthermore, a blade 10 made of a magnetic material attracts the magnetic field thereto as shown in FIG. 4 whereby the toner particles formed in brush shape are supported like a curtain between the toner bearing means and the doctor blade, thus preventing the loose toner particles 12 from going through under the blade, except for a small portion conveyed along the surface of the toner bearing means 8. In this manner it is rendered possible to obtain an extremely thin toner layer 11.

Figure 5:
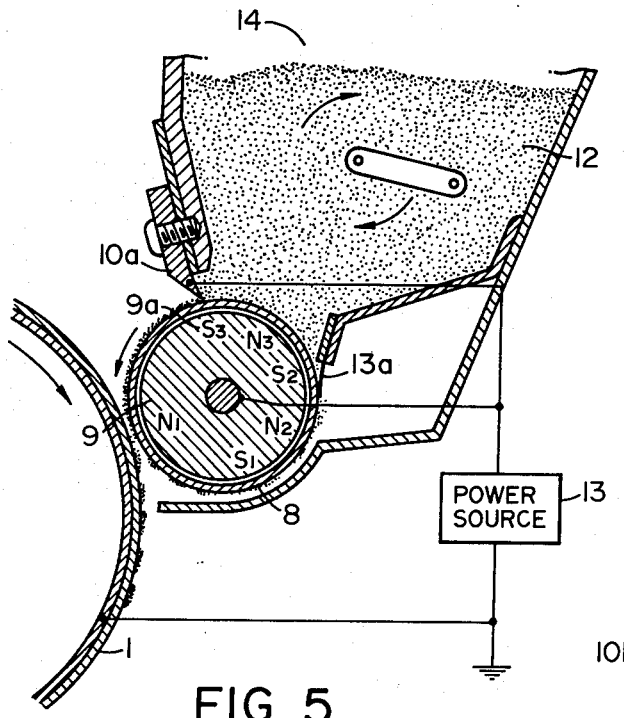
FIG. 5 is a cross-sectional view showing an embodiment of the developing apparatus of the present invention.

In the following there will be explained an embodiment of the present invention. Referring to FIG. 5, a permanent multi-poled magnet 9 is provided stationary while a non-magnetic cylinder 8 serving as the toner bearing member is rotated in a direction, as represented by arrow, same as that of displacement of the electrostatic image bearing surface 1. A one-component insulating ferromagnetic toner 12 supplied from a toner reservoir 14 is applied onto the external periphery of said non-magnetic cylinder 8 by the rotation thereof. Said cylinder and the toner particles are so selected in the charging series that a charge of a polarity opposite to that of the electrostatic charge is induced to the toner particles by the friction thereof with the cylinder surface. In the vicinity of the cylinder surface there is provided an iron blade 10*a* with a clearance of 50 to 500 microns from the cylinder surface. The blade 10*a* is for example of a shape as shown in FIG. 5 extending along the generatrix of the non-magnetic cylinder, and is positioned in opposed relationship to a magnetic pole 9*a* (pole S3 in FIG. 5) of the multi-poled permanent magnet 9 for limiting the toner layer into a small thickness of 30 to 300 microns, preferably in a range of 30 to 200 microns. The rotating speed of said cylinder is so regulated that the surfacial speed and preferably the internal speed of the toner layer are substantially same as or close to the speed of the electostatic image bearing surface. The blade 10*a* may be made of other magnetic materials instead of iron or of a magnet to constitute a counter magnetic pole. 13 is a power source for applying an alternating voltage between the non-magnetic cylinder 8 and the electrostatic image bearing member 1, while 13*a* is a scraper for eliminating the toner remaining on the toner bearing member. The blade 10*a* is maintained at a same potential as that of the toner bearing member for preventing eventual unevenness in the toner application.

The magnetic toner is for example of a mean particle size of 5 to 30 microns prepared in a known process from a mixture of 75 parts of polystyrene, 15 parts of magnetite, 3 parts of charge regulant and 6 parts of carbon. Naturally there can be employed any other known magnetic toner of the above-mentioned particle size containing magnetic powder in a proportion from 15 to 50 wt.%.

The mean particle size of the toner is defined as mentioned above, since a mean particle size smaller than 5 microns results in a strong electrostatic adhesion of the toner particles to the non-magnetic cylinder to hinder the cleavage of said particles therefrom, thus forbidding proper image development, and leads to the formation of a layer of fine toner particles on the surface of the non-magnetic cylinder, thus preventing the new toner particles from charging by contact with the cylinder surface and thus giving rise to a lowered developing density resulting from defective toner transfer. On the other hand a mean particle size in excess of 30 microns leads to a coarse image.

Also the magnetic powder content is defined in the above-explained manner as a content lower than 15 wt.% leads to the formation of toner particles with reduced magnetic powder content at the crushing operation for preparing the toner particles. Such particles with reduced magnetic powder content gives rise to an easily coagulable developer with reduced fluidity. Such developer tends to generate fog on the image because of the difficulty in uniform charging and of a reduced magnetic force for back transfer of the toner, and shows difficulty in magnetic transportation. On the other hand a magnetic powder content in excess of 50 wt.% leads to a deteriorated fixing property due to a reduced resin content, thus resulting in a coarse image quality.

For use in combination with the above-mentioned toner, there was employed an aluminum cylinder as the non-magnetic toner bearing member. The magnet was composed of a magnet roll of which polarity is alternated in the order of N-S-N-S for every quarter or octant segment. A magnetic pole is positioned in the closest position of the toner bearing member and the electrostatic image bearing member having a potential contrast of ca. 600 V, wherein the surface flux density was selected within a range of 600 to gauss as in the commercially available copiers.

Figure 6:
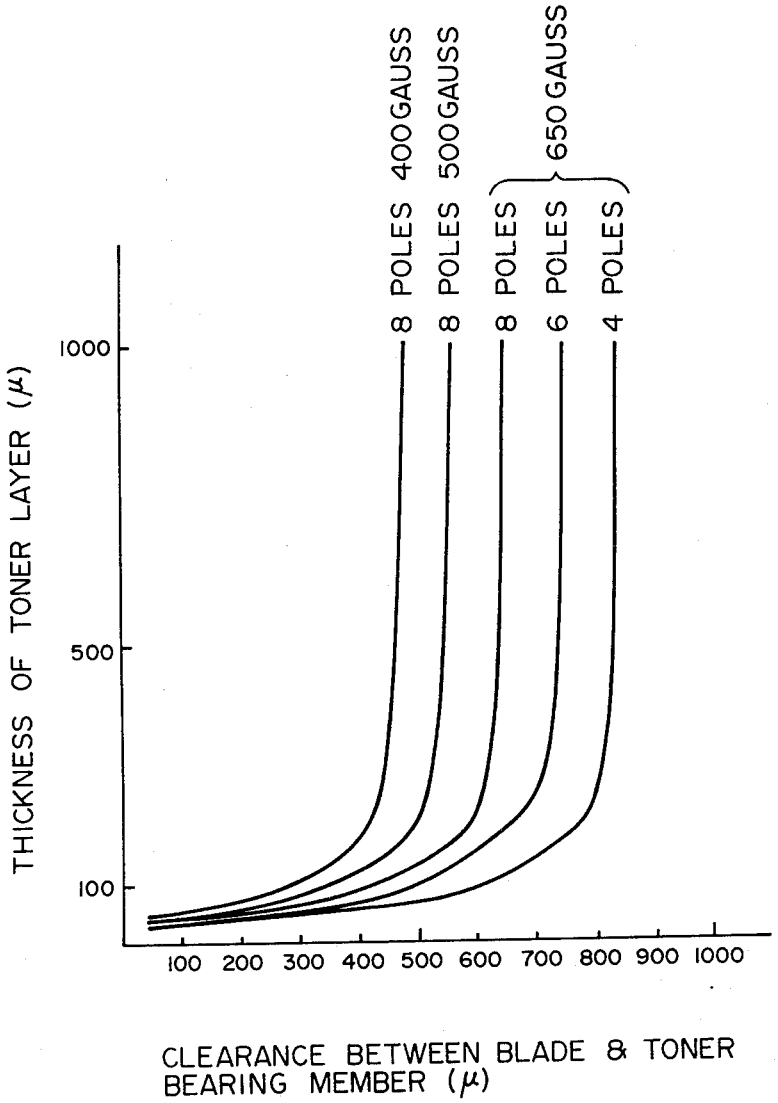
FIGS. 6 to 8 are characteristic charts showing experimental exaples of the present invention.
Figure 7:
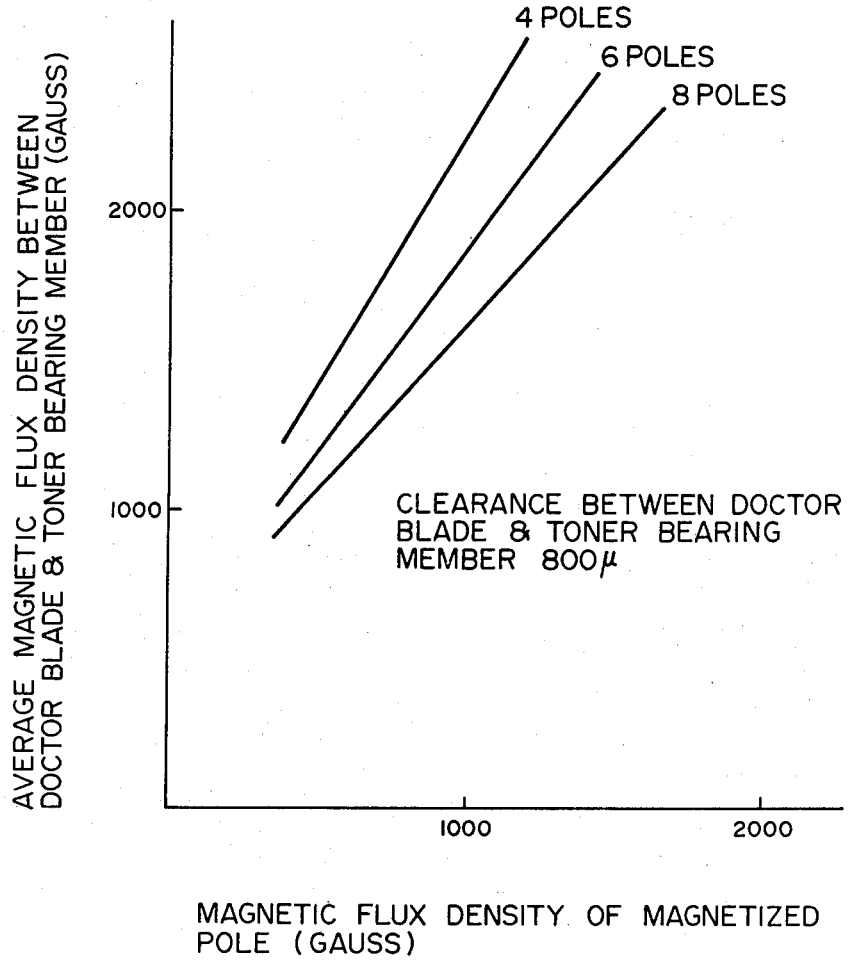
Figure 8:
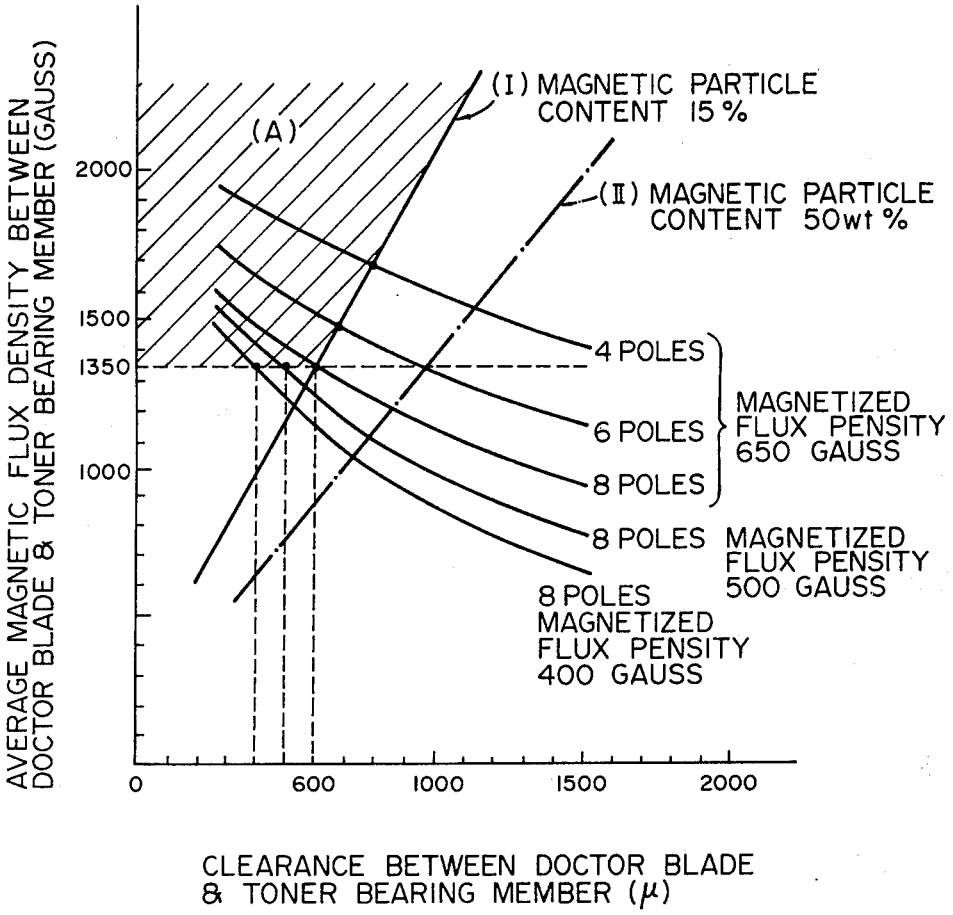

FIGS. 6 to 8 demonstrate the experimental results on the toner layer thickness and the magnetic flux density as a function of the positional relation of the iron doctor blade with respect to the electrostatic image bearing member.

More specifically, FIG. 6 shows the change in the thickness of the toner layer applied uniformly on the toner bearing member as a function of the clearance between the iron blade 10*a* and said toner bearing member, wherein a magnet roller 9 fixedly positioned inside a sleeve-shaped non-magnetic rotary toner bearing member 8 is provided with 4, 6 or 8 poles each generating a surface flux density of 650 gauss at the surface of said toner bearing member, or is provided with 8 poles each generating a surface flux density of 500 or 400 gauss.

As will be apparent from FIG. 6, the toner layer thickness becomes widely varied as a function of the pole distance or the surface flux density when the clearance between the blade and the toner bearing member is in excess of ca. 400 microns. The difference caused by the pole distance will be made clear for example by a comparison of the 4-poled and 8-poled magnet roll both having a surface flux density of 650 gauss. The former provides a thin uniform toner layer of ca. 200 microns thick in case said clearance is not in excess of ca. 800 microns, but developed an unevenness in the toner layer in the peripheral direction of the cylindrical toner bearing member at a clearance of 900 microns and provides a rapidly increasing toner layer thickness at a clearance of 1 mm or larger, thus becoming unable to a uniform thin toner layer desired in the present invention. In the developing area, therefore, the surface of the toner layer comes into contact with the latent image bearing member, thus forbidding the preferred development of the present invention to be detailed later. On the other hand the latter provides a thin uniform toner layer of ca. 200 microns thick when the clearance is not in excess of 600 microns, but develops an unevenness as explained above at a clearance of 700 microns and provides a thick toner layer unsuitable for the image development as explained above at a clearance of 800 microns or larger. Similarly a 6-poled magnet roll provides a thin uniform toner layer when said clearance is not in excess of 700 microns but provides a thick toner layer unsuitable for the preferred development of the present invention at a larger clearance.

As regards the effect of the change in the magnetic flux density at a constant pole distance, a thin uniform toner layer can be obtained up to a clearance of ca. 500 or 400 microns respectively when the surface flux density is changed from 650 gauss to 500 or 400 gauss in the 8-poled magnet roll shown in FIG. 6. Also a similar behavior is observed when the surface flux density of a 4-poled magnet roll is changed from 650 gauss to 850 gauss. It is further confirmed that an increase in the pole intensity of a 4-poled magnet roll up to 1300 gauss does not practically affect the developing performance except for slight thinning of image lines.

The foregoing results are based on a fact that the iron doctor blade positioned in facing relation to a magnetic pole of the magnet roll is induction magnetized by said pole to develop a strong magnetic field between said blade and the toner bearing member. FIG. 7 shows the intensity of said strong magnetic field measured with the magnet rolls shown in FIG. 6 and with a clearance of 800 microns between the blade and the toner bearing member. As shown in FIG. 7, the magnetic field between the blade and the toner bearing member becomes stronger as the pole distance increases or the magnetized width increases. Also at a contant pole distance, the magnetic field between the blade and the toner bearing member is approximately proportional to the flux density of the magnetized pole. As an example, a 4-poled magnet roll provides a mean magnetic field intensity of 1640 or 2100 gauss for a flux density of the pole of 650 or 920 gauss respectively at the surface of the toner bearing member.

In further connection with FIG. 7, FIG. 8 shows the change in the flux density between the iron blade and the toner bearing member as a function of the clearance therebetween, wherein there are employed the magnet rolls shown in FIG. 6. On FIG. 8 there are plotted points representing the clearance between the blade and the toner bearing member allowing proper limiting of the toner layer into a uniform and small thickness. As explained in the foregoing, in case of an 8-poled magnet roll, the clearance between the blade and the toner bearing member allowing to limit the toner layer into a uniform of ca. 200 microns is defined as ca. 400, 500 or 600 microns respectively corresponding to the flux density of the magnetic pole of said magnet roll of 400, 500 or 650 gauss. Such clearance values or 400, 500 or 600 microns respectively plotted on the corresponding flux density curves provide a mean flux density of ca. 1350 gauss between the blade and the toner bearing member. A lower flux density indicates an excessively wide clearance between the blade and the bearing member, which, as shown in FIG. 6, is unable to provide proper limiting of the toner layer thickness. From the foregoing it can be concluded that the flux density between the blade and the toner bearing member should be at least equal to 1350 gauss in order to limit the toner layer thickness into a range of 30 to 300 microns, preferably into a range of 30 to 200 microns, as already explained in the foregoing.

Similarly the maximum clearance providing a uniform and small toner layer thickness is defined as ca. 600, 700 or 800 microns respectively corresponding to a 4-, 6- or 8-poled magnet roll. The plottings of these clearance values on FIG. 8 provide a nearly straight line (I). From FIG. 6 the desired toner thickness limiting is evidently not achievable in a region at the right of said line (I). According to the present invention, therefore, it is necessary to select the combination of the clearance between the blade and the toner bearing member and the mean flux density therebetween in a narrower region between said line (I) and the ordinate, or i.e. a region at the left of said line (I). In making such selection the mean flux density has to be selected at a value at least equal to 1350 gauss as explained in the foregoing. It is therefore most desirable, according to the present invention to select the above-mentioned combination in the hatched area (A) in FIG. 8.

Also the present inventors have prepared a chart, similar to FIG. 6, for a magnetic powder content of 50 wt.% and for 4-, 6- and 8-poled magnet rolls, and have plotted, in FIG. 8, thus obtained values of the clearance between the blade and the toner bearing member allowing proper toner thickness limiting to obtain another chained line (II), defining a left-hand region in which proper toner thickness limiting is possible, and a right-hand region in which the toner layer is excessively thick for proper development. As is apparent from FIG. 8, the area (A) is included in said left-hand region of the line (II). This fact indicates that, in the present invention utilizing toner containing magnetic powder in a proportion of 15 to 50 wt.%, any toner satisfying the above-mentioned condition is usable as long as the aforementioned clearance and mean flux density are selected inside said area (A).

Although the charts shown in FIGS. 6 to 8 are prepared according to an experimental example, the basic scope of the present invention is by no means limited thereto as it has been confirmed in other experimental examples not described in the present specification.

In the foregoing embodiments the doctor blade may be composed as an integral part of the toner reservoir and may be inclined in a direction along the cylinder 8.

As explained in the foregoing, the present invention employs a one-component ferromagnetic toner, a non-magnetic cylinder as a toner bearing member encircling a multi-poled permanent magnet for realizing stable and easily controllable toner bearing on the toner bearing member, and a magnetic thin blade member in the vicinity of the surface of said cylinder in order to form a thin and uniform toner layer. Such magnetic retention of the toner layer on the toner bearing member allows, in comparison with retention by Van der Walls force or by electrostatic attraction, a far more uniform, stabler and easily controllable toner transfer to the latent image bearing surface. Also the use of a magnetic doctor blade provides a counter magnetic pole positioned facing to a magnetic pole of the permanent magnet located inside the toner bearing member thereby forcedly erecting the toner particle beads in the space between the blade and the toner bearing member, thus facilitating to obtain a thinner toner layer on other portions of the toner bearing member, for example the portion facing the electrostatic image bearing surface. Also such forced movement renders the toner layer more uniform, thus allowing the formation of a thin and uniform toner layer not obtainable with a non-magnetic doctor blade.

The foregoing description has been devoted to the formation of a thin uniform toner layer by the rotation of the toner bearing member. In the following there will be given an explanation on the case of rotating the magnetic poles of the magnet roll 9.

Figure 9:
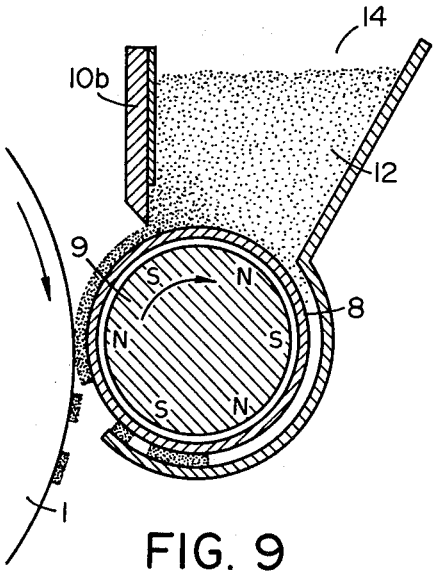
FIG. 9 is a cross-sectional view of an unpreferred embodiment of the developing apparatus.

FIG. 9 shows a structure in which the magnet roll 9 is rotated in a direction opposite to the displacement of the latent image bearing member 1, thereby applying the one-component insulating ferromagnetic toner 12 supplied from the toner reservoir 14 onto the non-magnetic cylinder 8 and providing the toner particles with a charge of a polarity opposite to that of the electrostatic image by the friction between the surface of said cylinder and the toner particles. A doctor blade **10*b* is positioned close to the surface of said cylinder, with a distance of 50 to 200 microns therefrom. The rotating speed of the multi-poled permanent magnet is so regulated that the surface speed of the toner layer is substantially same as or close to the speed of the electrostatic image bearing surface 1**.

As an example there is employed a permanent magnet roll having equally distanced six poles magnetized at a flux density of 650 gauss and alternated in polarity. The use of such rotating magnet roll did not provide a thin uniform layer but a thick toner layer, through uniform in thickness, which is unable to effect proper development preferred in the present invention because of the direct contact of the toner layer with the latent image bearing member. Besides such thick toner layer results in a deteriorated image quality because of the insufficient frictional charging of each toner particle with the toner bearing member. In such structure the doctor blade **10*b*** is periodically not in facing relation to any magnetic pole because of the rotating motion of the magnet roll, whereby the toner curtain is not formed between the blade and the cylinder because of the absence of the magnetic field therebetween in such state. Thus the toner particles can pass through under the blade to generate a thick toner layer.

The magnetic toner to be employed in the present invention is not limited to that of the composition and mean particle size mentioned in the foregoing embodiments, but generally include toner particles composed of various resins capable of inducing a determined charge by the friction with the toner bearing member and having a mean particle size in a range from 5 to 30 microns and a content of magnetic powder, such as magnetite, in a range of 15 to 50 wt.%. The toner bearing member is gounded to the frame of the apparatus in the foregoing embodiments, but it is also apply a DC or AC bias voltage to the toner bearing member. The use of the AC bias is detailedly explained in the U.S. Pat. applications Ser. Nos. 58,434 and 58,435, both filed July 18, 1979, of the present assignee. As an example a fog-free visible image with satisfactory continuous tone reproduction was obtained by forming a latent image with potentials of 500 V and 0 V respectively in the image area and non-image area in the aforementioned embodiment of FIG. 5 and applying, between the latent image bearing member and the toner bearing member, a voltage of an alternating waveform having peak values of 600 V and −200 V and overlapped with a DC component by a power source 13. A similar effect can be obtained with a distored alternating waveform or a square waveform. At said AC bias application the toner bearing member is spaced in the developing area from the electrostatic image bearing surface by a distance of 100 to 500 microns, preferably 200 to 300 microns. In such case the toner layer is made thinner than said distance, for example in a range of 30 to 300 microns or preferably in a range of 30 to 200 microns as explained in the foregoing thereby forming a clearance between the surface of the toner layer and the electrostatic image bearing surface. The alternating electric field across said clearance causes a reciprocating motion of the toner particles in said clearance, thereby effecting proper development. The toner is preferably insulating for the development and the subsequent image transfer.

The image development employed in the present invention is based on, in the absence of the alternating bias voltage, forming a toner layer on the toner bearing member with a thickness smaller than the clearnace between said toner bearing member and the electrostatic image bearing surface, thereby causing transfer of the toner to said image bearing surface in the image area thereof. At said transfer, the toner layer corresponding to the image area increases the thickness thereof in the direction of the electric field under the attracting function thereof, and simultaneously the toner is extended and erected in the form of spikes under the effect of the magnetic field emanating from the magnetic pole (said phenomenon hereinafter called toner extention). When the toner layer is brought close to the electrostatic image bearing surface the extended portion of said toner comes into direct contact with the image area of said image bearing member, and when the toner bearing member is separated from the image bearing surface the toner is retained on said image bearing surface to complete the image development. This developing process is different from so-called contact development or toner transfer development, and is considered to achieve the image development by the toner contact in the image area by the aforementioned toner extention while the toner is maintained free from contact with the non-image area.

In case the clearance between the surface of the toner layer and the electrostatic image bearing surface is larger than explained in the foregoing, the image development by the above-explained toner extention seems to be also assisted by a developing phenomenon in which the toner particles are snapped from the tip of toner spikes extending in the electric field but not contacting the image bearing surface and are made to fly toward the image bearing surface.

According to the present invention it is rendered possible to effect the development based on the aforementioned toner extention and the coexistent development by the toner flying as explained above, according to the clearance between the electrostatic image bearing surface and the toner bearing member. In this manner the use of the development by the toner extention in which the toner layer is extended to come into direct contact with the image area of the image bearing surface reduces the dependence on the toner particles flying across said clearance, thereby significantly reducing the influence of the air flow in said clearance, weight of the toner and vibration of the image bearing surface or the toner bearing member. Thus it is rendered possible to obtain a visible image of an excellent image quality showing faithful image reproducibility and not associated with background fog, and the dimensions of various portions of the developing apparatus are preferably selected to satisfy this condition. In order to ensure satisfactory toner extention, the clearance between the surface of the toner layer in a non-extended state corresponding to a non-image area and the electrostatic image bearing surface if preferably selected not in excess of three times of the toner layer thickness. Also in order to realize the aforementioned development principally based on the toner extention and combined with the toner flying, the above-mentioned clearance is selected not in excess of ten times of the toner layer thickness.

According to the experimental and theoretical analyses, the clearance D between the toner bearing member and the electrostatic image bearing surface is preferably maintained in a range $50\mu \leqq D \leqq 500\mu$, wherein the upper limit is determined from the requirement for satisfactorily developing characters printed with the smallest commercial type font (100 microns) while the lower limit is determined in relation to the toner layer thickness. Also experimentally the thickenss a of the toner layer formed on the toner bearing member is preferably maintained within a range of $30\mu \leqq a \leqq 300\mu$. At the development the toner layer is extended in the form of spikes in the presence of a magnetic field to a height approximately equal to three times of the toner layer thickness as explained in the foregoing. Thus in order that the surface of the toner layer can reach the image bearing surface, the clearance b between the surface of the toner layer and said image bearing surface should be maintained in a range of $b \leqq 300\mu$. Generally a preferable result can be obtained by selecting the value b in a range of $b \geqq a/5$. The positioning of the electrostatic image bearing surface at a determined distance from the toner bearing member can be achieved by a spacer, roller, spring or other positioning member engaging with the image bearing surface of the backing electrode thereof and combined with the toner bearing member.

In addition to the foregoing advantages, the developing apparatus of the present invention is capable of providing a fog-free visible image rich in tonal rendition, by means of the use of an alternating bias voltage. Also in application in a copying or recording apparatus involving an image transfer step, said developing apparatus allows an excellent image transfer, thereby providing a fog-free image with an extremely improved image quality on a plain paper.

The present invention is not limited to the foregoing embodiments but includes all other embodiments covered by the scope of the present invention.

What we claim is:

1. A developing apparatus for developing an electrostatic latent image formed on an electrostatic image bearing means, by providing said latent image with a developer, said apparatus comprising:

a movable toner bearing member for carrying thereon a magnetic toner;

toner supply means for supplying magnetic toner to said toner bearing member;

magnetic field generating means fixedly provided inside said toner bearing member; and a toner thickness limiting member comprising a magnetic material positioned within the extent of a magnetic field generated by a magentic pole of said magnetic field generating means and in the vicinity of the external periphery of said toner bearing member;

wherein said magnetic toner is provided with a mean particle size in a range of 5 to 30 microns and contains magnetic powder in a range of 15 to 50 wt.%, and wherein the magnetic pole of said magnetic field generating means is so selected as to maintain a magnetic field of at least 1350 gauss in average between said toner thickness limiting member and said toner bearing member thereby forming the toner layer of a determined thickness on said toner bearing member.

2. A developing apparatus according to claim 1, wherein the clearance between the toner thickness limiting member and the toner bearing member is selected with respect to characteristics defined by a narrow area present betweeen an ordinate line obtained by connecting the points representing a limit value of said clearance for thin and uniform toner layer formation respectively plotted on the curves showing the means flux density between the toner thickness limiting member and the toner bearing member as a function of the clearance therebetween.

3. A developing apparatus according to claim 1, wherein the toner layer thickness is limited by said toner thickness limiting member to a value smaller than the clearance between said toner bearing member and said electrostatic image bearing means thereby maintaining a clearance between the surface of the toner layer and said electrostatic image bearing means.

4. A developing apparatus according to claim 3, wherein said developer is an insulating material.

5. A developing apparatus according to claim 3 or 4, wherein an alternating voltage is applied across said clearance.

6. A developing apparatus according to claim 5, wherein said alternating voltage is an AC voltage of a distorted waveform.

7. A developing apparatus according to claim 5, wherein said toner thickness limiting member is maintained at a same potential as that of said toner bearing member.

8. A developing apparatus according to claim 3, wherein said toner bearing member is separated from said electrostatic image bearing means by a distance in a range of 100 to 500 microns.

9. A developing apparatus according to claim 3, wherein said toner bearing member is separated from said electrostatic image bearing means by a distance in a range of 200 to 300 microns.

10. A developing apparatus according to claim 3, wherein the thickness of the toner layer is in a range of 30 to 300 microns.

11. A developing apparatus according to claim 3, wherein the thickness of the toner layer is in a range of 30 to 200 microns.

12. A developing apparatus according to claim 1, further comprising a scraper for removing the toner remaining on said toner bearing member.

13. A developing apparatus according to claim 1, wherein the magnetic pole positioned in facing relation to the toner thickness limiting member generates a flux density not less than 750 gauss at the surface of the toner bearing member.

14. An apparatus according to claim 1, wherein said toner thickness limiting member has an edge for contacting the toner line.

* * * * *

UNITED STATES PATENT AND TRADEMARK OFFICE

CERTIFICATE OF CORRECTION

PATENT NO. : 4,297,970

DATED : November 3, 1981

INVENTOR(S) : HATSUO TAJIMA, ET AL.

It is certified that error appears in the above—identified patent and that said Letters Patent is hereby corrected as shown below:

Abstract, line 8, "contain" should read --contains--.

Column 1, line 25, "bed carrier" should read --bead carrier--;

line 26, "fur etc." should read --fur, etc.--;

line 27, "include" should read --includes--;

lines 27-28, "utilizing suspended" should read --utilizing a suspended--;

line 37, "surface etc." should read --surface, etc.--;

line 49, "magne-dry" should read --magnetic-dry--;

lines 51-52, "the tendecy of background fog formation" should read --their tendency to form background fog--;

line 52, "undifferential" should read --undifferentiated--.

Signed and Sealed this

Sixteenth Day of March 1982

[SEAL]

Attest:

GERALD J. MOSSINGHOFF

Attesting Officer

Commissioner of Patents and Trademarks